United States Patent [19]

Ipock

[11] Patent Number: 4,633,846

[45] Date of Patent: Jan. 6, 1987

[54] COMBINATION STABILIZER/HUNTING KNIFE FOR COMPOUND BOW

[76] Inventor: William Ipock, R.R. #1, P.O. Box 146A, Summerville, Mo. 65571

[21] Appl. No.: 710,500

[22] Filed: Mar. 11, 1985

[51] Int. Cl.[4] ..... F41B 5/00; F41B 11/00; B26B 11/00

[52] U.S. Cl. ..... 124/23 R; 124/89; 124/80; 124/DIG. 1; 7/158

[58] Field of Search ..... 124/89, 88, 80, 23 R, 124/24 R, 86; D8/104, 105; D22/1, 5; 7/158, 106

[56] References Cited

U.S. PATENT DOCUMENTS

| | | | |
|---|---|---|---|
| 152,847 | 2/1949 | Weiss | D8/104 |
| 2,938,514 | 5/1960 | Berg | 124/88 |
| 3,154,063 | 10/1964 | White | 124/80 |
| 4,169,454 | 10/1979 | Jones | 124/23 R |
| 4,309,974 | 1/1982 | Carter et al. | 124/23 R |
| 4,378,781 | 4/1983 | Shiflett | 124/24 R |

FOREIGN PATENT DOCUMENTS

| | | | |
|---|---|---|---|
| 1296201 | 11/1972 | United Kingdom | 124/89 |

OTHER PUBLICATIONS

Bow & Arrow, The Game Tracker, advertisement, p. 41, Jun. 1982.

Bow & Arrow, Saunders Archery Company, advertisement, p. 19, Oct. 1985.

*Primary Examiner*—Richard C. Pinkham
*Assistant Examiner*—Benjamin Layno
*Attorney, Agent, or Firm*—Paul M. Denk

[57] ABSTRACT

A stabilizer for archery bow of the type incorporating a flexible strip with a cord between its ends, bent into the bow formation, and for use for projecting an arrow, such bows normally being unbalanced in their stability, this invention incorporating a length of tubular member, fastened to the front of the bow, at a position generally downwardly of its central portion. The tubular member incorporates other structure in the category of a knife, track line, or other weight, to enhance the weight of the overall stabilizer through that quantity that balances the bow to the state of equilibrium at its central portion. The tubular member has a cavity to accommodate the weight structure, and a closure member for the tubular cavity.

3 Claims, 14 Drawing Figures

COMBINATION STABILIZER/HUNTING KNIFE FOR COMPOUND BOW

BACKGROUND OF THE INVENTION

This invention relates generally to the fabrication of a stabilizer for application to an archery bow, thereby properly balancing the weight of the bow and adding to its stability during usage, and at the same time, including internally within its structure means having other applications in the nature of a hunting knife, or the like, or a track line for facilitating the finding of any arrow projected from the bow.

The field of archery has been rather extensively expanded over the past few years, and not only has archery become rather recognized as truly a sporting event, since it is now incorporated within Olympic competition, but at the same time, the use of the bow and arrow for hunting pursuits has become in vogue. And, the archery bows have been significantly improved, principally through the design and manufacture of the compound bow, but which incorporates a multitude of weight adding pulley means at the ends of the bow in order to provide for multiple increase in the force of projection that may be attained for any arrow shot from the instrument. The increased weight given to any such bow through the addition of these improvement features, as explained, has not only added to the weight of the instrument which in and of itself is an inconvenience to the archer, but in addition, maintaining the stability for the bow, as during usage, has become a detriment. Thus, the desire of this invention is to provide improvement means for addition to the bow structure, and while it does add some additional weight to the overall embodiment, the means desireably provide for the convenient balancing of the weight of the bow so that stability can be reasonably attained and maintained by the archer either while participating in archery competition, or when pursuing the hunt.

It is, therefore, the principal object of this invention is to provide a weighted structure that is generally added to the bow at that location which tends to equalize and properly balance the weight of the bow to assure its stability while held by the archer during aiming and projecting of an arrow.

Another object of this invention is to provide means that not only adds to the stabilizing weight of the bow structure, but in addition, may incorporate other means having further utility for enhancement of the bow during its usage.

Yet another object of this invention is the incorporation of a hunting or other knife into the weight stabilizing means added to the structure of an archery bow.

Still another object of this invention is to incorporate a track line, or track means, within a weight stabilizing device added to the structure of an archery bow, so that the track line may be used for the prompt finding of any arrow shot from said bow.

These and other objects may become more apparent to those skilled in the art upon reviewing the summary of this invention, and upon undertaking a study of the description of its preferred embodiment, in view of the drawings.

SUMMARY OF THE INVENTION

This invention contemplates a modification to the stabilizer for a bow, particularly of the compound bow type, which, as is well known in the art, such stabilizers are used to provide weighted means that counter balances the overall weight of the compound bow, so as to facilitate its hold by the archer when taking aim and applying the bow as during target practice, hunting, in competition, or the like. As is known, the stabilizer added to a compound bow is of a particular weight, normally within the range of a multitude of ounces, and has a tendency to equalize the balance for the bow during application, as previously explained. In this particular instance, the stabilizer, being of a rather solid or tubular form of metallic rod, as under normal circumstances, comprises a hollowed out or interiorly formed cavity within the tube structure forming the equalizer, generally of a metal, and which at one end incorporates means for attachment of the stabilizer to the bow structure, such as through a screw or other type of threaded connection. In this particular instance, the tubular formed stabilizer has a threaded end, and into this end, which provides an entrance into its internal cavity, a shaped knife, such as a hunting knife, can be secured directly within the tubular means, and function effectively as an enhancement to the weight of the stabilizer and its integral tubular means during compound bow usage. In addition, by locating the blade of the knife within the tubular cavity, and threadedly or otherwise connecting the knife, as by its handle, to the end of the tubular means, said blade is effectively protected within the stabilizer, so that when not in use, the hunter's knife, or more specifically its blade, will be concealed from view, cause no injury of any sort, be protected against the elements, all due to its locating entirely within the tubular means of the stabilizer of this invention. On the other hand, when the knife is required for usage, such as for cleaning game, for cutting purposes, or for other applications, it can be simply unfastened; or unscrewed, from its placement within the tubular means of the stabilizer, pulled free, and is ready for usage. The mounting of the stabilizer to the bow can be easily performed, as for example, through a screw or bolt fastening, at the opposite end of the tubular means for the stabilizer, directly to the bow structure. Generally, extra weight is required downwardly from the central portion of the compound bow, and therefore, as will be reviewed in this application, this stabilizer means normally will be arranged at the lower, or below the center line, of the frontal portion of the bow structure.

It will also be obvious, upon reviewing this structure of this invention, that the stabilizer of this invention, as formed, can have other applications than for holding a knife, as for example, other instrumentalities utilized in bow hunting, are for use in conjunction with the bow, and of smaller size, may conveniently fit within the tubular means of the stabilizer of this invention, as will be subsequently explained, but instead of having the knife located in place, a cap may be threadedly engaged or otherwise secured onto the frontal end of the said tubular means forming the stabilizer of this invention. Thus, the cap may be inserted in place so as to confine these other instrumentalities within the stabilizer structure. As for example, where the stabilizer may have other application, other than for holding a knife, a track line may be spooled, or otherwise located conveniently within the tubular means of the stabilizer, and be attached to any arrow shot from the bow. In that instance, any cover applied to the stabilizer may have a fine aperture provided centrally through it, preferably at its central location, where the track line may be fed out of, for attachment to a bow, so that when a shot is made, the track line will be freed for unencumbered release from the stabilizer for pulling by the bow, so that the hunter may easily and conveniently follow his track line for recovery of any bow previously shot. This is just an example of a further application of the stabilizer of this invention as modified for use with other instrumentalities such as a knife, track line or other means. Obviously, any further modifications to the stabilizer for use in conjunction with other instrumentalities, will have to be properly weighted, so that the stabilizer will yet perform its prime function, and that is to achieve stabilization of the bow and balancing of its weight for more accurate usage during application.

DESCRIPTION OF THE PREFERRED EMBODIMENT

Figure 1:
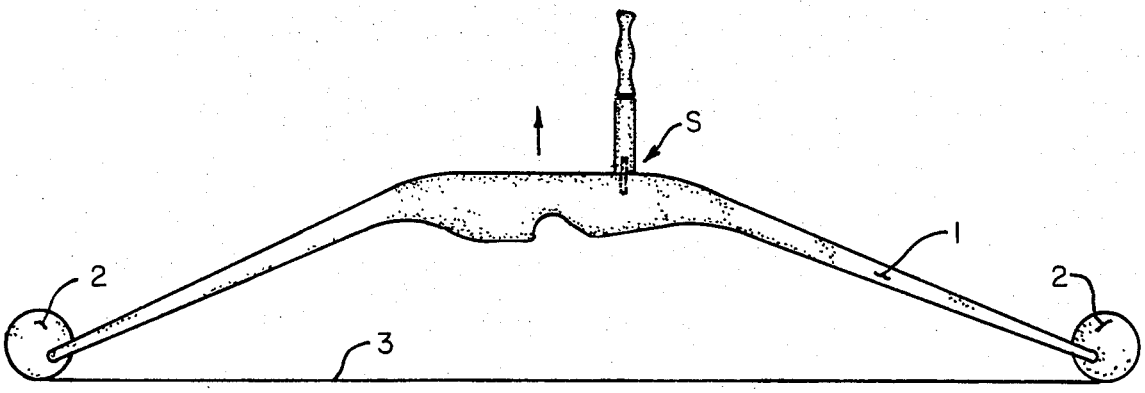
FIG. 1 provides a side view of a compound bow having the stabilizer means of this invention secured to its frontal surface.

In referring to the drawings, and in particular FIG. 1, therein is disclosed the stabilizer means S of this invention being mounted to the front and normally slightly downwardly from the central portion of the bow 1, which usually is of the compound style, having a series of pulleys 2 connected at either end of the said bow and incorporating the cord 3 therebetween for furnishing the means for delivering the sufficient force for the projection of an arrow under great speed and velocity.

Figure 2:
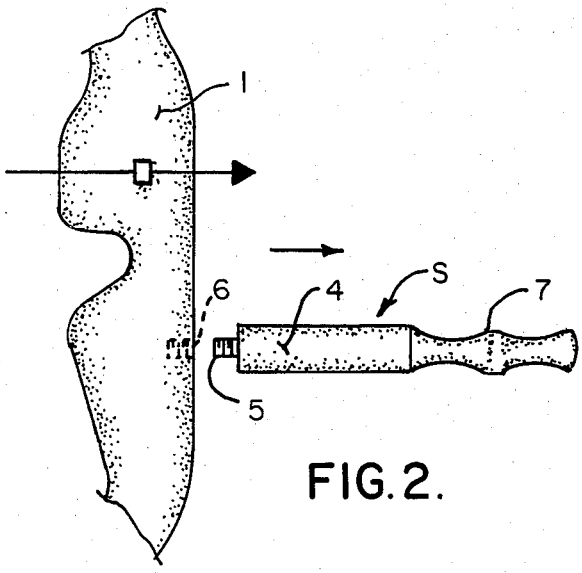
FIG. 2 discloses the stabilizer means of this invention as being removed from the front of a bow which is only partially shown herein.

As can be seen in FIG. 2, the stabilizer means S of this invention is formed of a tubular member 4 which has a threaded shaft or screw 5, or other connecting means, projecting from one end, as can be noted, and which can be secured or threadedly engaged within the aperture 6 formed within the compound bow 1. At the other end of the stabilizer means S, or more specifically its tubular means 4, projects the handle 7 which adds further weight for stabilization of the bow, and in this particular instance, the handle is formed for holding of a blade, as at 8, disclosed in FIG. 4. This combination handle 7 and blade 8, as can be readily determined, is of high utility to the hunter when the compound bow is being employed for that type of sporting event.

Figure 3:
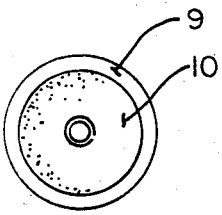
FIG. 3 is an end view, the threaded end, of the stabilizer means of this invention, upon its removal from attachment with the bow, in a manner as shown in FIG. 2.
Figure 4:
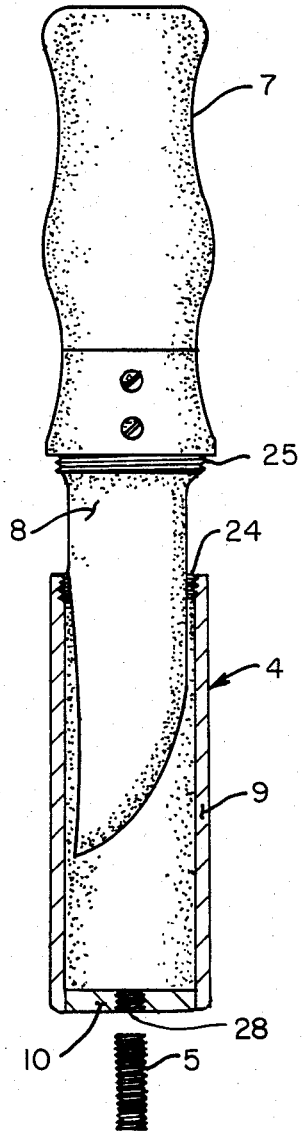
FIG. 4 is a side view of the stabilizer means of this invention, in cross-section, and also showing a knife, or hunting knife, as being either inserted or removed from within the tubular means of the stabilizer.
Figure 5:
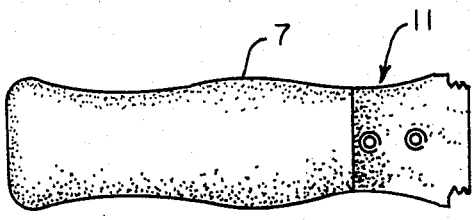
FIG. 5 is a side view of the handle for the knife.
Figure 6:
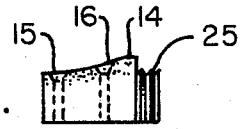
FIG. 6 discloses a top view of a fastening means normally used for holding the blade of the hunting knife to its handle.
Figure 7:
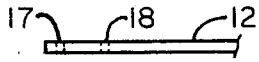
FIG. 7 discloses a top view of the back end or tang portion of the blade for the hunting knife, and which inserts between the handle means of FIG. 5, and the connecting means of FIG. 6, for securement of the blade to its handle.

As also seen in FIGS. 3 and 4, the tubular means or member 4 of this invention includes its sleeve like portion, having an end plate 10 integrally secured therein, as by a weld, or other form of attachment, and which end plate may be provided with a threaded aperture, as at 28, for holding the screw 5 firmly in place, as to this stabilizer, as at one end, as can be seen in FIG. 2, while also being threadedly engaged within the aperture 6 provided at the frontal portion of the compound bow.

It can readily be seen from FIGS. 1 and 2 that a bow of this particular structure can be, and normally is, rather off balanced in equilibrium, so that they usually tend to be somewhat top heavy in structure, making it a little difficult for convenient sighting while the archer is focusing in on his goal, whether it be a target, as in practice, or game out in the field. Hence, normally the stabilizer of this invention will include that sufficient amount of weight and which is located slightly downwardly from the center of the formed bow, so as to counter balance that excessive weight which is normally located upwardly of the center line of the said bow structure. The precise amount of weight, in addition to its precise distance downwardly from the center line of the bow, can be easily determined upon reviewing the subject matter of this invention. In the preferred embodidment, the stabilizer S of this invention may be within the vicinity of 4 to 16 ounces, 7 ounces being preferable for this embodiment, and located a distance of approximately 2 to 6 inches downwardly from the center line of the compound bow structure, which in this particular instance, is a form of compound bow manufactured by and readily available from many companies.

Figure 8:
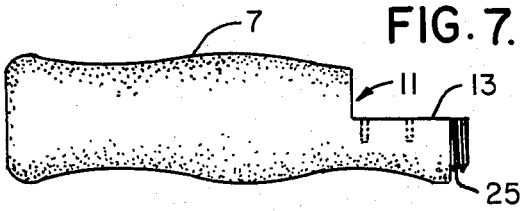
FIG. 8 is a top view of the handle as shown in FIG. 5.
Figure 9:
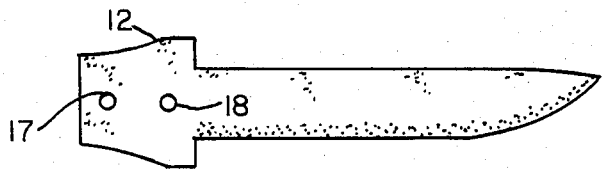
FIGS. 9 through 11 show various styles of knife blades that may be used in conjunction with this invention.
Figure 10:
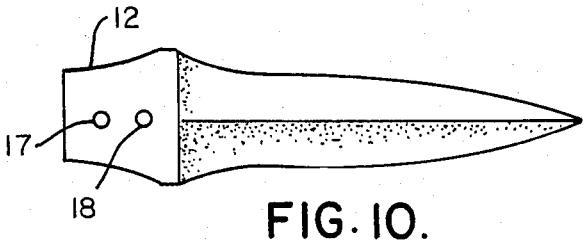
Figure 11:
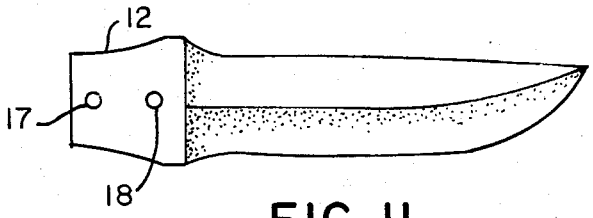

In further reviewing the subject matter of this invention, and particularly in reviewing FIGS. 4 through 8, it can be seen that the handle structure 7 of this invention incorporates a frontal portion that is separated in structure, having approximately a one-half cut-out section 11, as noted. This cut-out section is arranged approximately at the mid point, or slightly less, of the handle, as can be seen in FIG. 8, so that the tang or base portion 12, can be easily located into position resting against the surface 13 of said handle, while the remaining connector portion 14 is arranged into position upon the tang 12, with one or more screws (not shown) then being arranged through the aligned apertures 15 and 16, for tightly securing the blade to its handle, as can be seen. To accommodate this type of structural connection, it can be seen that any screw means may be readily removed, and different forms of blades, as shown in FIGS. 9 through 11, each having a tang or base portion 12 of equidistant apertures 17 and 18, can be readily replaced and located in proximity and tightened to the handle 7, for ready application as a knife, or hunter's knife, as required.

Figure 12:
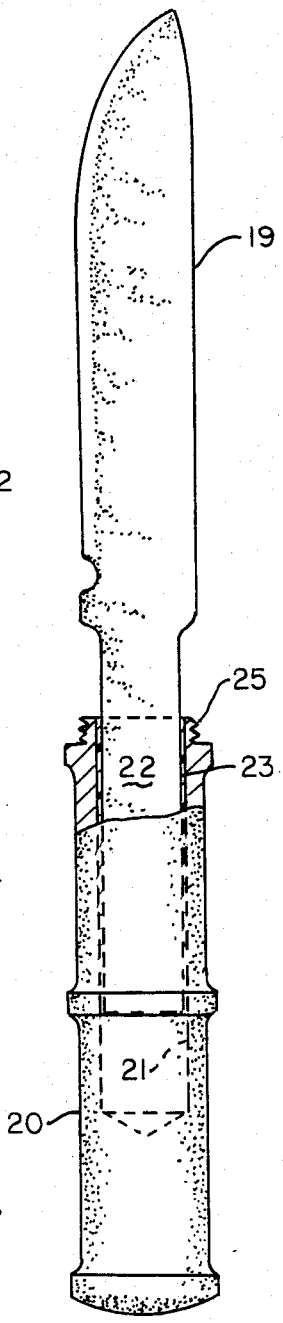
FIG. 12 shows another style of knife, or hunter's knife, wherein the blade, through its tang, is permanently mounted within its disclosed handle, part of which is broken away to disclose its interrelated structure.
Figure 13:
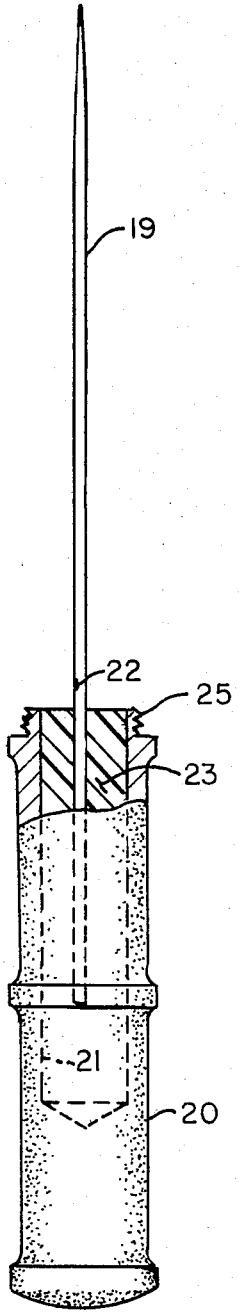
FIG. 13 is a top view of the knife as shown FIG. 12.

In addition to the foregoing, it is just as likely that the blade 19 for any knife can be permanently sealed to its handle structure 20. As can be seen in FIGS. 12 and 13, the handle 20 has an internal cavity 21 drilled therein, and the tang portion 22 located within said drilled portion and epoxyed, adhesively connected, or other means of connection may be used for permanent mounting as by means of the securement matter 23 within the formed handle 20.

It should also be noted from the various figures for this particular invention that any knife structure is provided with means for its securement partially within the tubular member 4 of the invention. In the preferred embodiment, it can be seen at the upper end of the tubular member 4, as in FIG. 4, is provided with a series of threads, as at 24. Likewise, the forward end of the handle 7, or the back end of the blade 8, may contain a series of integral threads, as at 25, and which are lined with and correspond to the threads 24 for providing their threaded engagement therewith, as when it is desired to secure the knife, and more particularly its blade, within the tubular member 4 of the stabilizer, in order to provide that compound weight for the overall stabilizer, required for equibalancing the weight of the compound bow during its usage. In addition, locating the blade within the tubular member 4 adds to its safety, to prevent any accidental cutting of anyone, and at the same time, shelters the blade from the elements, so as to prevents its accelerated deterioration as through oxidation. A similar type of thread means 25 may be provided upon all of the knife structures in their various embodiments as disclosed for this invention, and be readily secured in place within the tubular member 4 by threadedly engaging with the threads 24 as disclosed. Obviously, though, other forms of connection other than the threaded connection may be made for securement of the knife, and particularly its blade, in place within the tubular member 4 of the stabilizer.

Figure 14:
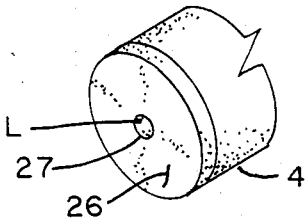
FIG. 14 discloses the tubular means forming the stabilizer of this invention and having a cap secured thereon with a track line extending from its interior through a small aperture provided centrally of said cap.

Another aspect for usage of this invention includes the adaptation of the stabilizer of this invention for use for holding a track line for application to the arrows being shot from the bow. As can be seen in FIG. 14, the tubular member 4 has a cap 26 threadedly or otherwise secured to its upper end, which in this particular instance the cap may be threaded internally within the threads 24 of the tubular member, or perhaps the proximate end of the tubular member may be externally threaded, for accommodating the engagement of the cap 26 thereon. In any event, the cap includes a fine aperture 27 therethrough, and through which the track line L may insert for tying on to any arrow being shot from the bow. Internally of the tubular member, the track line may be rolled upon any spool, or conveniently wound therein for ease of its withdrawing as the arrow, to which it connects, is rapidly propelled at high speed after being shot from the bow. In any event, the tubular member 4, as analyzed with respect to that shown in FIG. 4, will be held onto the front of the compound bow, as disclosed in FIG. 1. And, the tubular member in this instance will have a predesigned and significant weight to counterbalance any unequilibrium in weight of the compound bow and of the type as previously analyzed and described in this description.

Variations or modifications to the stabilizer/bow knife structure of this invention may occur to those skilled in the art upon reviewing the description of the invention provided herein. Such modifications or variations, if within the spirit of this invention, are intended to be encompassed within the scope of any claims to patent protection issuing upon this invention. The description of the preferred embodiment herein, as well as its illustration within the appended drawings, are set forth for illustrative purposes only.

Having thus described the invention what is claimed and desired to be secured by Letters Patent is:

1. The combination of a stabilizer contained hunting knife and an archery compound bow of the type incorporating a flexible strip of material of wood, connected proximate its ends with a cord, for use for projecting an arrow, said bow normally being unbalanced in its stability, comprising, a length of tubular means fastened to the front of said bow at a position generally downwardly of its central portion, said tubular means being threadedly engaged with said bow, said tubular means having a cavity provided therethrough and extending approximately the length of the said tubular means, an end plate formed at one end of the tubular means said end plate having a threaded means attached thereto, said threaded means also fastening the tubular means to the said bow, said tubular means incorporating means therein to enhance its weight to a quantity that balances the bow to the state of equilibrium at its central portion, said weight enhancing means comprising a knife, a closure means for said tubular means to close the said formed cavity, said closure means comprising a connection of said knife with the said tubular means, said knife having a blade, a handle securing to said blade, said handle forming the closure means through its securement with tubular means, said handle means proximate its attachment to the blade having a series of threads provided thereat, said tubular means having a threaded end, and said knife handle threads engaging with the threaded end of the tubular means to provide the closure for the formed cavity, with the knife blade being enclosed within the tubular means, and the knife handle extending axially and exteriorly from the tubular means and from the bow to which the tubular means fastens.

2. The invention of claim 1 and wherein said blade being removable from said handle.

3. The invention of claim 1 and wherein said blade at one end being embedded within said knife handle.

* * * * *